US006708753B1

(12) United States Patent
Brantley

(10) Patent No.: US 6,708,753 B1
(45) Date of Patent: Mar. 23, 2004

(54) METHOD AND APPARATUS FOR CASTING STRAPS ONTO STORAGE BATTERY PLATES

(75) Inventor: Randall F. Brantley, Fishers, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/295,655

(22) Filed: Nov. 14, 2002

(51) Int. Cl.[7] ..... B22D 23/04
(52) U.S. Cl. ..... 164/136; 164/130
(58) Field of Search ..... 164/129, 130, 164/133, 134, 135, 136

(56) References Cited

U.S. PATENT DOCUMENTS 4,108,417 A 8/1978 Simonton et al. ..... 249/81
4,525,438 A * 6/1985 Pearson ..... 429/149
4,729,542 A 3/1988 Bechtold ..... 249/96
4,742,611 A * 5/1988 Meadows et al. ..... 29/623.1
4,800,142 A * 1/1989 Bish et al. ..... 429/130
5,206,987 A * 5/1993 Mix ..... 29/623.1
5,487,496 A 1/1996 Benson ..... 222/593
5,520,238 A 5/1996 Hopwood ..... 164/337
6,006,439 A * 12/1999 Del Mercado et al. ..... 34/61

* cited by examiner

*Primary Examiner*—M. Alexandra Elve
(74) *Attorney, Agent, or Firm*—Jimmy L. Funke

(57) ABSTRACT

A method and apparatus for preparing connecting straps and end terminals for lead batteries by filling selected cavities of the mold is disclosed. The mold has cavities for casting connecting straps and an end terminal. Molten lead is filled up to an amount of lead sufficient to fill the preselected cavities of the mold. The content of the mold is brought together with inverted plate lugs of grouped battery plates to fuse the plate lugs together with the content of the mold prior to solidification. The method and apparatus includes a first mold block having at least three mold cavities in an upper face thereof, whereby at least two preselected cavities of the at least three mold cavities are translationally aligned to be filled with lead.

11 Claims, 4 Drawing Sheets

METHOD AND APPARATUS FOR CASTING STRAPS ONTO STORAGE BATTERY PLATES

TECHNICAL FIELD

This disclosure relates to lead-acid batteries and, more particularly, to a method and apparatus for delivering molten lead or a lead alloy to the cast-on-strap molds used in the manufacture and assembly of lead-acid batteries.

BACKGROUND OF THE INVENTION

Electrochemical storage batteries, and in particular, lead sulfuric acid storage batteries are ubiquitous in automotive applications. These batteries have electrochemical cells developing about 2.1 Volts each. Generally, six of these cells are connected in series to produce the 12 Volt battery known as a SLI (starting, lighting, ignition) battery common in automobile systems.

The cell elements comprise a series of alternating positive and negative plates with separators positioned therebetween. The electrical connections for the positive plates, and the negative plates as well, are typically made by a strap which connects the lugs of individual plates together. The straps are made of a wide variety of molten lead, or, more usually, lead-based alloys.

Various machines have been developed and used over the years to cast the straps onto the cell elements in a semi-continuous manner. Such machines have often been termed "cast-on-strap machines". Generally, cast-on-strap (COS) machines require inserting the cell element upside down into a mold for the strap. The lug elements for the respective plates are thus positioned in a mold containing the requisite molten lead or molten lead alloy, and the molten material is allowed to solidify. The cell element is then removed with the cast-on-strap in place.

Typically in COS machines, stacked battery plates and separators for a plurality of cells making up a lead-acid storage battery have the respective connection lugs on the positive and negative plates of each cell interconnected by a cast-on strap and an intercell connecting post or terminal post cast as an integral portion of each strap. These casting operations are accomplished simultaneously with the cells inverted but otherwise oriented as they are to be in the finished battery structure. Stacked cell elements are clamped with the plate lugs extending downward. A plurality of properly oriented mold cavities (e.g., 12 cavities for a 12V battery) are preheated then molten lead is poured or flows into each mold cavity. The clamped cell assemblies are positioned to immerse a portion of the plate connecting lug on each plate in the molten mass in an appropriate connector strap cavity. The cavities are then chilled, as by flowing water through the body of the mold, and when the molded straps and posts solidify adequately they are extracted from the mold with the plates fused thereto.

Mold expense is a significant factor in machines of the type under consideration. It has been difficult to obtain suitable castings in which mold forms can be produced. The variety of cell and terminal arrangements required for lead-acid batteries has further complicated mold construction. Furthermore, the simultaneous casting operation discussed above necessitates large expensive molds and large casting machines.

In accordance with the above, it is desirable to improve mold assemblies for battery strap and post cast-on machines.

It is further desired to decrease cycle time of battery strap and post cast-on machines while reducing the cost and size of mold assemblies and casting machines.

SUMMARY OF THE INVENTION

A method and apparatus for preparing connecting straps and end terminals for lead batteries by filling selected cavities of one or two molds is disclosed. A first mold includes five mold cavities in an upper face thereof, whereby at least two preselected cavities of the five mold cavities are translationally aligned to be filled with lead to form a first strap/post terminal configuration while another at least two preselected cavities of the first mold form a second strap/terminal configuration. A second mold includes five mold cavities in an upper face thereof that form third and fourth strap/post terminal configurations depending on which two cavities are selected and translationally aligned to be filled with lead. The first and seconds molds form four different strap/post configurations for connecting individual cells formed from the two molds in a multi-cell battery. In another embodiment, a single mold includes five cavities in an upper face thereof, whereby at least two preselected cavities of the five mold cavities are selected to form a selected strap/terminal configuration. The single mold forms four different strap/post configurations for connecting individual cells formed from the two molds in a multi-cell battery.

In another embodiment, a method for casting straps onto storage battery plates is disclosed. The method includes providing a source of molten lead, receiving a first mold block having five mold cavities in an upper face thereof in a first molding station, whereby at least two preselected cavities of the five mold cavities are filled with lead, translating the mold block to align each of the at least two preselected cavities with the source of molten lead, and translating the battery plate group or the mold block toward a battery plate group to dip lugs of the group into the at least two preselected cavities and allow solidification of the molten lead producing a molded cell for placement in a multi-cell battery.

The above-discussed and other features and advantages of the present invention will be appreciated and understood by those skilled in the art from the following brief description of the drawings.

BRIEF DESCRIPTION OF THE DRAWINGS

Referring to the exemplary drawings, which are meant to be exemplary, not limiting, and wherein like elements are numbered alike in several figures.

DETAILED DESCRIPTION OF THE INVENTION

Figure 1:
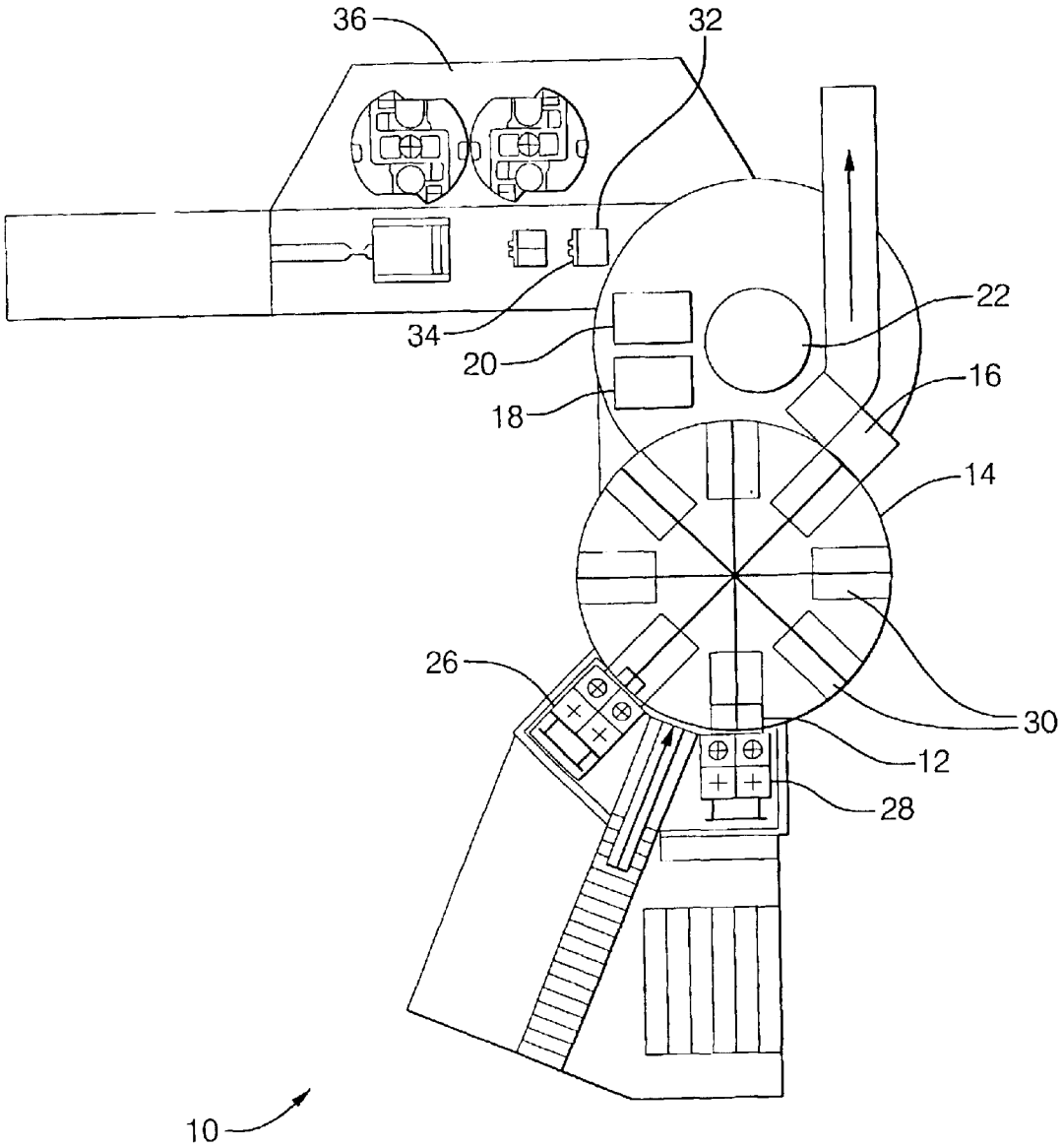
FIG. 1 is a partially broken away schematic perspective view of the operating elements of the apparatus in which the mold assemblies of this disclosure are utilized.

A small cast-on strap (COS) machine in which the mold assembly 12 of this disclosure is utilized is shown generally at 10 in FIG. 1 as comprising a cast-on station 14 having a transfer station 16 for unloading lead-acid battery cells resulting from mold assembly 12, a lug burnishing station 20, a lug fluxing station 18, and a transfer mechanism 22 in operable communication with a rotable receptacles 30 disposed on a periphery portion of cast-on station 14. Transfer mechanism 22 also allows transfer to perform burnishing and fluxing operations at stations 20 and 18 and also loads the rotating receptacles 30. In addition, transfer mechanism 22 unloads the rotating receptacles 30 for further processing of resulting battery cell elements at transfer station 16. Cast-on station 14 is in further operable communication with two molding stations 26, 28. Controls (not shown) for the COS machine 10 are automatically or semi-automatically operated to advance mold assemblies 12 produced at cast-on station 14 through other processes, such as cooling, by rotating cast-on station in a counter-clockwise direction, for example. Transfer mechanism 22 transfers elements through the burnishing, fluxing and then on cast-on station 14. Cast-on station 14 is configured to receive molding assembly 12 on cast-on station 14 for advancement to the molding stations 26, 28 of cast-on station 14 in proper timing and sequence to result in casting cell strap and post terminals on the lugs of the positive and negative battery plates 32 disposed in molding assembly 12 for each cell to connect those respective lugs electrically and mechanically and to form intercell connector lugs or battery terminal posts (not shown) in appropriate spatial relationship for latter placement in a battery case.

The COS machine includes a drive means (not shown) for operable rotation of cast-on station 14. Stacks of interleaved positive and negative battery plates 32 with suitable separators are mounted with their lugs extending downward and clamped together, typically by a machine operator actuating manual controls. When all plates 32 are aligned and stacked, the stack is elevated by transfer mechanism 22 and advanced at a level to carry the lugs 34 through a rotating burnishing brush in burnishing station 20. The stack then advances to a position above fluxing station 18, is stopped and lowered to dip the lugs 34 in a fluxing solution. It is then raised and permitted to drain.

At an appropriate point in the cycle of machine control, the mold assembly 12 is preconditioned for casting. The stack is then advanced in its elevated condition from the fluxing station 18 to the cast-on station 14. In a preferred embodiment, transfer mechanism 22 is a robot configured to provide suitable transfer functions outlined above. The cast-on station 14 rotates toward molding stations 26, 28 to immerse lugs 34 in molding assembly 12 for injecting molten lead in selected mold cavities for the connector straps and post terminals. It will be appreciated that although injection of lead is discussed, other methods to fill the mold cavities can be used. For example, mold assembly is optionally filled by, but is not limited to, dipping or by selectively pouring molten lead in the mold cavities.

Coolant is circulated through jackets around the mold cavities to freeze the posts and straps and when an appropriate temperature has been achieved the cast post and strap are extracted from their molds by simultaneous operation of extractors driven by a knock-out plate in synchronism with the stack elevator. The cell unit with straps and post terminals are then rotated along in one of receptacles 30 to the transfer station 16 where, for example, the machine operator releases the molded cell from the mold assembly 12. In one arrangement a molded cell is then inserted into a case where individual cells are later electrically and mechanically joined via the straps to form intercell connections.

Figure 2B:
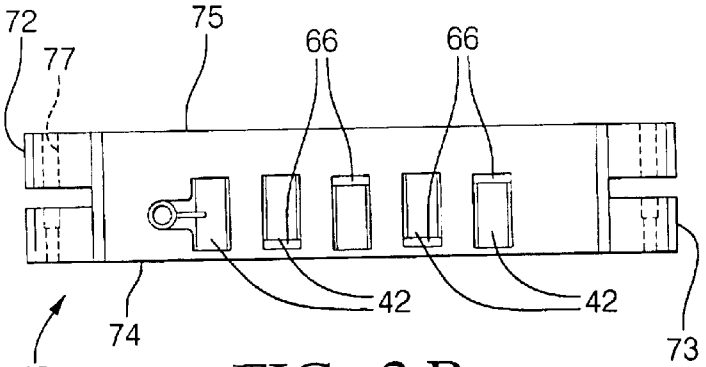
FIG. 2B is a top view of an exemplar complementary mold of FIG. 2A having five cavities that cast straps in a second configuration for another cell of the battery.
Figure 2D:
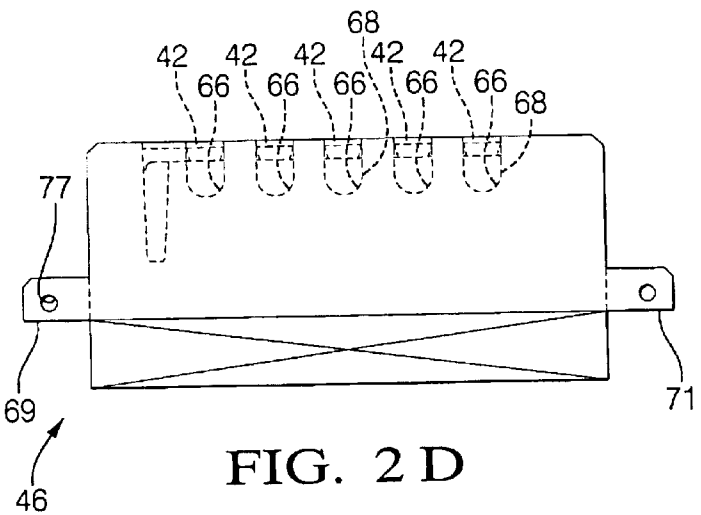
FIG. 2D is a side view of the mold of FIG. 2B illustrating U-shaped flanges extending from straps formed by the cavities.
Figure 2A:
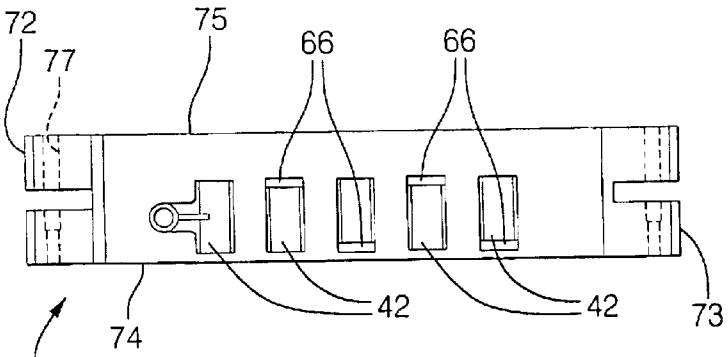
FIG. 2A is a top view of one exemplary mold having five cavities for allowing flow of lead therethrough that cast straps in a first configuration for a cell in a battery.
Figure 2C:
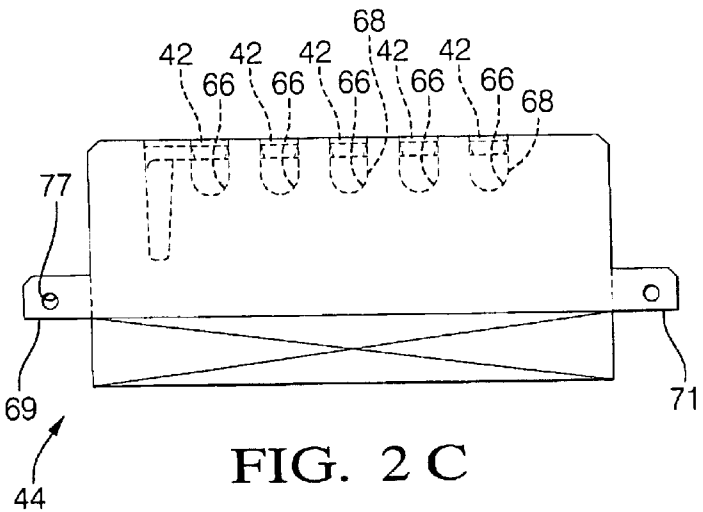
FIG. 2C is a side view of the mold of FIG. 2A illustrating U-shaped flanges in the first configuration extending from straps formed by the cavities.

The cast-on process outlined utilizes a mold filling technique referring to FIGS. 2A–2D. Two different configurations of mold assemblies 44 and 46 are depicted for injection of molten lead in two of five cavities 42 for each mold assembly 12. FIGS. 2C and 2D are cross sectional side views of mold assemblies 44 and 46 shown in FIGS. 2A and 2B, respectively. Each mold produces at least one cell of a battery (not shown). When it is desired to inject the mold cavities 42, a lead injection machine (not shown) at molding stations 26, 28 is used is to inject molten lead into at least two mold cavities 42, preferably simultaneously to decrease cycle time.

It will be appreciated from the preceding discussion that a substantial degree of precision of control of thermal conditions are required at the cast-on station 14. The cavities must be cooled sufficiently to solidify the metal for extraction in the form of straps and possibly a post terminal. The molten metal in the cavities cannot be so hot at the time the lugs 34 are immersed that they detrimentally affect the overlying cell assemblies as by melting the plates 32, separators between the plates, or the lugs 34 above the region of immersion.

One form of an exemplary mold assembly 12 which affords three different configurations for a cell is shown in FIGS. 2A and 2C generally at 44. A second form of an exemplary mold assembly which affords one more alternative configuration for a cell and a total of three different configurations is shown in FIGS. 2B and 2D generally at 46. By filling two contiguous cavities 42 of the five cavities 42 in each mold assembly, three different configurations for each mold 44, 46 result depending on which two contiguous cavities 42 are selected. It will be understood that each mold assembly is translatable up and down relative to FIGS. 2C and 2D, as well as being translatable in left and right directions as shown relative to FIGS. 2A–2D for selecting two of the five cavities to be filled.

Referring to FIGS. 2A–2D, and 3, mold cavities 42 in six individual molds assemblies 12 for a six cell battery 48 are shown including cavities for a negative terminal post 51, a first cell negative strap 52 and a positive strap 53, a second cell positive strap 54 and negative strap 55, a third cell negative strap 56 and positive strap 57, a fourth cell positive strap 58 and negative strap 59, a fifth cell negative strap 61 and positive strap 62, a sixth cell positive strap 63 and negative strap 64, and a positive terminal post 65. The cavities 51 and 65 for the terminal post are continuous with the cavities 52 and 63 of the first and sixth cells for the connector straps of the appropriate polarity. All other connector strap cavities include an intercell connector post cavity 66 adjacent a similar post cavity for the strap of opposite polarity for the next cell whereby the connection of adjacent connector posts connect the battery cells in series electrically. Intercell connector post cavity 66 molds a U-shaped flange 68 that extends substantially perpendicular from one end of a molded strap 53–62, and 64. U-shaped flange 68 is long enough for electrically joining contiguous straps of opposite polarity by, welding, for example.

Figure 3:
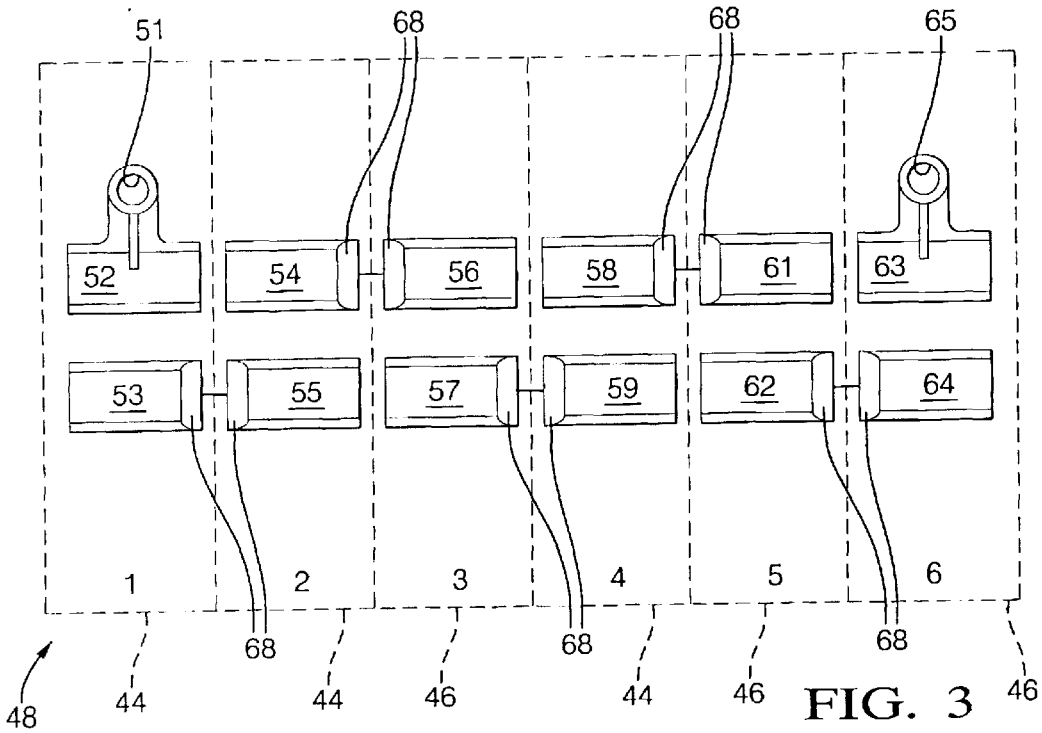
FIG. 3 is a plan view of a 12V battery having six cells similar to those shown in FIGS. 2A–D illustrating electrical communication between contiguous cells through opposite polarity terminal connection with an intercell connector.

In one embodiment and still referring to FIGS. 2A–D and 3, it will be recognized that six cells forming battery 48 in FIG. 3 optionally includes three cells formed using mold assembly 44 and the other three cells formed using mold assembly 46. More specifically, the first cell (1) of battery 48 is formed by injecting the two leftmost cavities of mold assembly 44 in FIG. 2A, forming negative terminal post 51, first cell negative strap 52 and positive strap 53. The second cell (2) is optionally formed by injecting either the two rightmost cavities 42 of mold assembly 44 in FIG. 2A or a pair of contiguous cavities contiguous to the two right most cavities 42, forming second cell positive strap 54 and negative strap 55. The third cell (3) is optionally formed by injecting either the two rightmost cavities 42 of mold assembly 46 in FIG. 2B or a pair of contiguous cavities 42 contiguous to the two right most cavities 42, forming negative strap 56 and positive strap 57. The fourth cell (4) is optionally formed by injecting either the two rightmost cavities 42 of mold assembly 44 in FIG. 2A or the pair of contiguous cavities 42 contiguous to the two right most cavities 42, forming positive strap 58 and negative strap 59. The fifth cell (5) is optionally formed by injecting either the two rightmost cavities 42 of mold assembly 46 in FIG. 2B or the pair of contiguous cavities 42 contiguous to the two right most cavities 42, forming negative strap 61 and positive strap 62. The sixth cell (6) is formed by injecting the two leftmost cavities 42 in FIG. 2B, forming positive strap 63 and negative strap 64, and positive terminal post 65. By translating mold assemblies 44, 46 in right and left directions, two of the five cavities 42 may be selected to inject molten lead to provide the desired strap/post configuration for each cell of battery 48 using two molds in three cycles.

Still referring to FIGS. 2A–2D, the mold assemblies 12 further include end bosses 69 and 71, ends 72 and 73 and sides 74 and 75. A mounting cavity 77 is provided in each of the bosses to enable the molding assembly to be clamped in the cast-on station 14 by means (not shown).

After filling is complete, for example, as determined by a timer set for the rate of molten metal flow, the molten metal solidifies in the preselected cavities and mechanically and electrically joins the isolated straps to corresponding lugs. The resulting cell unit is extracted from the mold assembly 12 and transferred for further processing. Six cell units are disposed in a 12 V battery case having flanges 68 aligned with holes in the cell partition walls within the battery case. Contiguous flanges 68 are then electrically connected, e.g., by welding, to complete a series connection between adjacent cells.

Figure 4A:
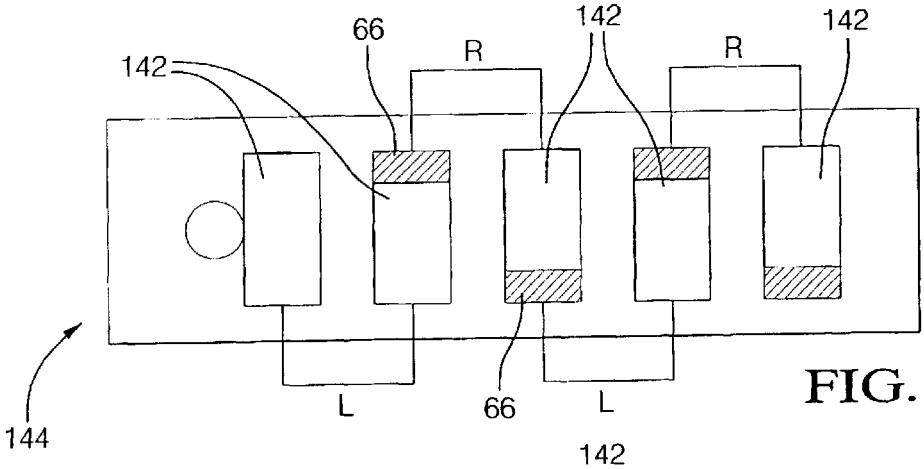
FIG. 4A is a top view of an alternative exemplary mold having five cavities for allowing flow of lead therethrough that cast straps in a first set of configurations for a cell in a battery.
Figure 4B:
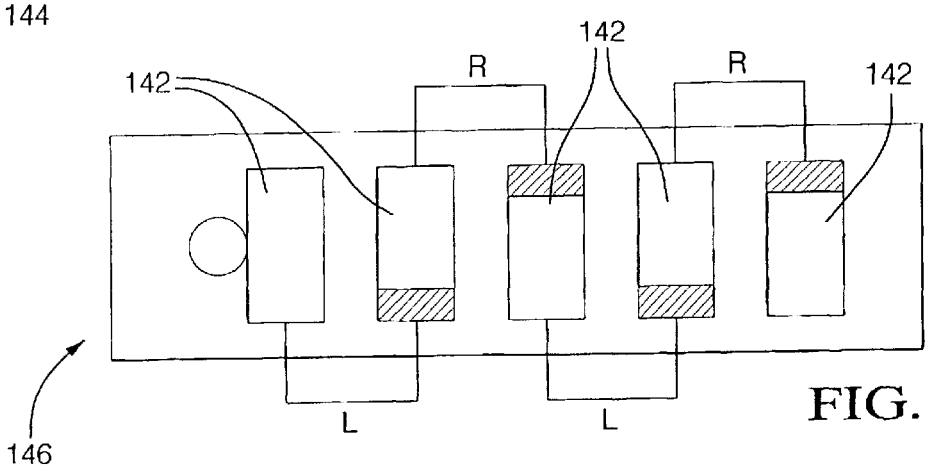
FIG. 4B is a top view of an alternative exemplar complementary mold of FIG. 4A having five cavities that cast straps in a second set of configurations for a cell of the battery.

Referring now to FIGS. 4*a* and 4*b*, the two exemplary embodiments of molds 44 and 46 shown in FIGS. 2A and 2B are reproduced schematically as molds 144 and 146, respectively. Molds 144 and 146 are schematic representations of molds 44 and 46 illustrated in FIGS. 2A and 2B each mold having five cavities 142. In an exemplary embodiment, molds 144 and 146 allow twelve cell elements for use with two batteries to be molded in three cycles as opposed to molding six cells elements for use in one battery in three cycles using molds 44 and 46 discussed above.

In an exemplary embodiment and referring to FIGS. 4A and 4B, the first four or four left most cavities 142 of each mold 144 and 146 is filled with molten lead in the first and third cycles of three cycles to provide eight cell elements of the twelve cell elements needed to complete two batteries. Four of the eight cells are the outermost cells with post terminals while the other four are intermediary cell elements, two for each battery. In the second cycle, the last four or four rightmost cavities of each mold 144 and 146 as depicted are filled with molten lead to provide four more intermediary cell elements.

The cycle time is the same as described above with molds 44 and 46, however, by filling four instead of two cavities at each cycle, battery production is doubled. It will be recognized that the above process necessitates a larger COS machine and may be more complex than that described with a three cavity mold 44, 46, however, using two five cavity molds provides another choice for matching production requirements to available equipment and tooling investment.

Figure 5:
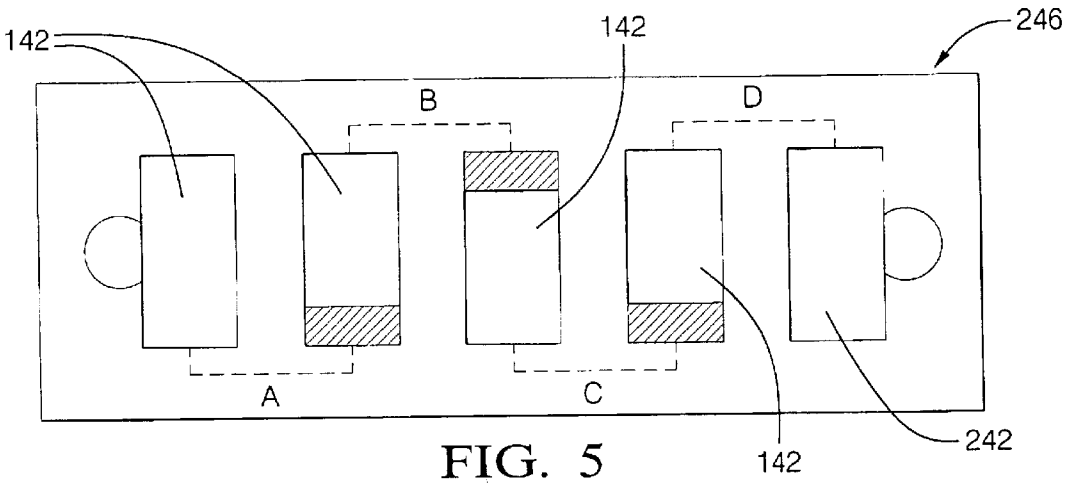
FIG. 5 is a top view of yet another exemplary single mold having five cavities for allowing flow of lead therethrough that cast straps/terminals in four configurations for a cell in a battery.

In yet another alternative embodiment and referring to FIG. 5, an exemplary embodiment of a single five cavity mold 246 is depicted. Mold 246 is similarly configured to mold 146 illustrated in FIG. 4B, except for a fifth and rightmost cavity 242 of mold 246 is configured to mold a terminal post with a strap connector. In this manner, if the first two and leftmost cavities are filled with molten lead, a cell configuration shown in cell 6 of FIG. 3 results. Likewise, if the last two or rightmost cavities are filled with molten lead, a cell configuration shown in cell 1 of FIG. 3 results. Cells 2 and 4 are configured by filling the second and third cavities of mold 246, while cells 3 and 5 of FIG. 3 are configured by filling the third and fourth cavities of mold 246.

Using mold 246, six cell elements are produced for use in a single battery in six cycles where two of the five cavities are injected with lead at each cycle to form a single cell element. Alternatively, six cell elements may be produced for use in a single battery in four cycles using mold 246 as described below.

Figure 6:
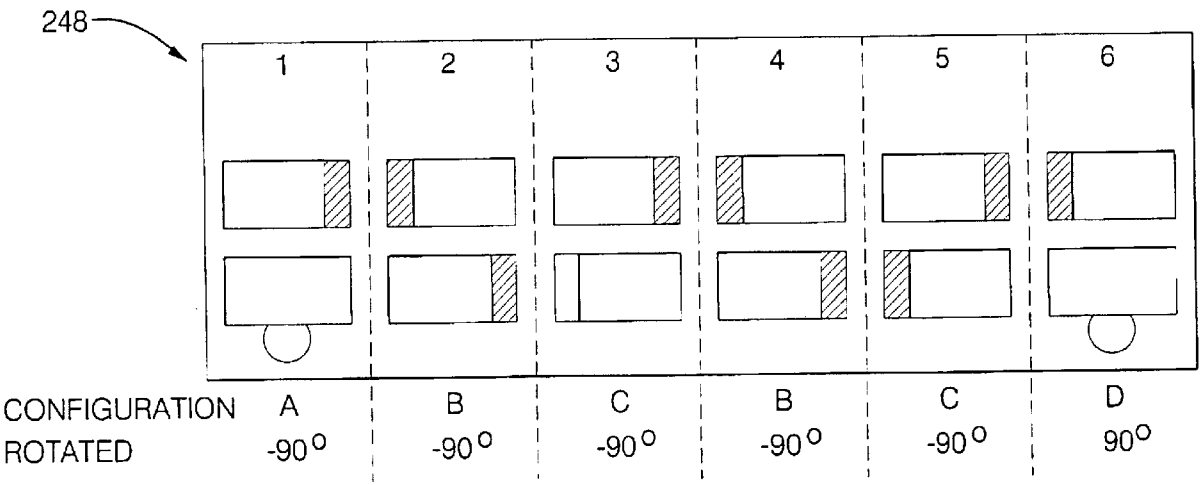
FIG. 6 is a plan view of another 12V battery having six cells similar to those shown in FIG. 3 illustrating placement of molded cell configurations formed with the mold of FIG. 5 and electrical communication between contiguous cells through opposite polarity terminal connection with an intercell connector.

Referring to FIGS. 5 and 6, injecting the first and second cavities of mold 246 provides an "A" configuration having a post terminal for a first cell of battery 248, shown in cell 1 of FIG. 6. It will be recognized that battery 248 in FIG. 6 is similarly configured to battery 48 in FIG. 3 although rotated 180°. Injecting the second and third cavities of mold 246 results in a "B" configuration for a second and fourth cell of battery 248, shown in cells 2 and 4 of FIG. 6. Injecting the third and fourth cavities of mold 246 results in a "C" configuration for use in the third and fifth cells of battery 248, shown in cells 3 and 5 of FIG. 6. Injecting the fourth and fifth contiguous cavities of mold 246 results in a "D" configuration having another post terminal for use in the sixth cell of battery 248, shown in cell 6 of FIG. 6.

Still referring to FIGS. 5 and 6, an exemplary method is outlined for molding six cell elements for battery 248 in four cycles. In a first cycle, the first four or four leftmost cavities of mold 246 are filled resulting in an A configuration and a C configuration. Both A and C configuration cells are rotated −90° for placement in battery 248 as first and third cell elements, shown in cells 1 and 3 of FIG. 6, respectively. In a second cycle, the last four or four rightmost cavities of mold 246 are filled providing a B configuration and a D configuration. The B configuration molded cell clement is rotated −90° while the D configuration molded cell element is rotated +90° for placement in battery 248 as the second and sixth cell elements, shown in cells 2 and 6 of FIG. 6, respectively. In a third cycle, the second and third cavities of mold 246 are filled providing another B configuration. This second B configuration molded cell element is rotated −90° for placement in battery 248 as a fourth cell element, shown in cell 4 of FIG. 6. In the final fourth cycle, the third and fourth cavities of mold 246 are filled providing another C configuration. This second C configuration molded cell element is rotated −90° for placement as a fifth cell element in battery 248, shown in cell 5 of FIG. 6.

It will be understood by one skilled in the pertinent art that the apparatus and method discussed above for use in manufacturing cells of a 12 V battery is optionally employed in the manufacture of cells for use in a 36 V battery. A 36 V battery includes a battery housing or case defining a receiving area that is configured to receive and engage eighteen cells. Each cell has a plurality of positive plates each having a positive tab portion or lug depending outwardly from a periphery, a plurality of negative plates each having a negative tab portion or lug depending outwardly from a periphery, and a nonconductive separator disposed in between the plurality of positive plates and the plurality of negative plates. The tabs or lugs for the plates are analogous to lugs 34 of battery plates 32 discussed above in reference to a 12 V battery.

Accordingly, the above described method and apparatus affords casting straps to individual cells for use in a battery with a smaller and less expensive mold, as well as allowing a smaller COS machine to be employed because of the smaller mold. In addition, each mold provides at least two configurations for use in connecting lugs of contiguous cells of a battery depending on the cavities selected to fill with molten lead. The above described method and apparatus allows more flexibility and allows a single COS machine to mold the totality of cells to be employed in a battery. By using two COS machines in conjunction with 2 molds, cycle time can be gained.

While preferred embodiments have been shown and described, various modifications and substitutions may be made thereto without departing from the spirit and scope of the invention. Accordingly, it is to be understood that the apparatus and method have been described by way of illustration only, and such illustrations and embodiments as have been disclosed herein are not to be construed as limiting to the claims.

What is claimed is:

1. A method for casting elements onto storage battery plates comprising;

providing a source of molten lead;

receiving a first mold block having five mold cavities linearly aligned in an upper face thereof in a first molding station, whereby at least two preselected cavities of the five mold cavities are filled with lead;

translating the mold block to align each of the at least two preselected cavities with the source of molten lead; and translating the mold block toward a battery plate group to dip lugs of the group into the at least two preselected cavities.

2. The method of claim 1 wherein the five cavities comprise a first cavity configured to form one of a first strap and a first post terminal, a second strap cavity configured to form a second strap, a third strap cavity configured to form a third strap, a fourth strap cavity configured to form a fourth strap, and a fifth post terminal cavity configured to form a second post terminal.

3. The method of claim 2 wherein the first, second, third, and fourth straps are configured having an extension tab extending substantially perpendicular thereto, each extension tab extending from an opposite end of a respective contiguous strap of the first, second, third, and fourth straps.

4. The method of claim 3 wherein first, second, third and fourth straps are contiguous on the mold block.

5. The method of claim 4 further comprising a second mold block, wherein the second mold block includes five cavities, the five cavities further comprise a sixth strap cavity configured to form a sixth strap, a seventh strap cavity configured to form a seventh strap, an eighth strap cavity configured to form an eighth strap, a ninth strap cavity configured to form a ninth strap, and a tenth post terminal cavity configured to form a third post terminal, the sixth, seventh, eighth, and ninth straps are contiguous and each strap includes the extension tab in an opposite orientation of the first, second, third, and fourth straps, respectively.

6. The method of claim 5 wherein first mold having first cavity configured to form said first post terminal and first mold having first cavity configured to form first strap together with second mold provide four different configurations of strap and terminal connectors.

7. The method of claim 5 wherein twelve cell elements are manufactured in three cycles using first and second molds with two molding machines, first mold having said first cavity configured to form said first strap.

8. The method of claim 6 wherein six cell elements are manufactured in one of four and six cycles using first mold having said first cavity configured to form said first post terminal with a single molding machine.

9. The method of claim 8 further comprising:

selecting a first four contiguous cavities including said first cavity;

filling said first four contiguous cavities with molten lead;

joining a first two cells to respective cavities to form first and second molded cell elements;

selecting a second four contiguous cavities including said fifth cavity;

filling said second four contiguous cavities with molten lead;

joining a second two cells to respective cavities to form third and fourth molded cell elements;

selecting a first two contiguous strap cavities including said second strap cavity;

filling said first two contiguous strap cavities with molten lead;

joining a first single cell to said first two contiguous strap cavities to form a fifth molded cell element;

selecting a second two contiguous strap cavities including said fourth strap cavity;

filling said second two contiguous strap cavities with molten lead; and joining a second single cell to said second two contiguous cavities to form a sixth molded cell element.

10. The method of claim 1 wherein the source of molten lead is a lead injection machine.

11. The method of claim 7 wherein the cell elements produced are disposed in a battery case wherein each extension tab is aligned with holes in cell partition walls within the battery case, each extension tab aligned with another extension tab in a contiguous cell for electrically joining tabs extending in contiguous cells together to provide a series connection between the cells of the battery.

* * * * *